US010808458B1

(12) United States Patent
Franklin

(10) Patent No.: US 10,808,458 B1
(45) Date of Patent: Oct. 20, 2020

(54) LADDER SAFETY DEVICE

(71) Applicant: Dale C. Franklin, El Dorado, CA (US)

(72) Inventor: Dale C. Franklin, El Dorado, CA (US)

( * ) Notice: Subject to any disclaimer, the term of this patent is extended or adjusted under 35 U.S.C. 154(b) by 0 days.

(21) Appl. No.: 16/531,040

(22) Filed: Aug. 3, 2019

Related U.S. Application Data

(60) Provisional application No. 62/863,794, filed on Jun. 19, 2019.

(51) Int. Cl.
*E06C 7/00* (2006.01)
*E06C 7/18* (2006.01)

(52) U.S. Cl.
CPC ..... *E06C 7/006* (2013.01); *E06C 7/182* (2013.01)

(58) Field of Classification Search
CPC ..... E06C 7/006
See application file for complete search history.

(56) References Cited

U.S. PATENT DOCUMENTS 3,311,195 A * 3/1967 Singer ..... E06C 1/18 182/230
5,421,428 A * 6/1995 Ingles ..... E06C 7/006 182/106
6,364,057 B1 * 4/2002 Cornejo ..... E06C 7/006 182/106
7,032,711 B1 * 4/2006 Katz ..... B25H 3/06 182/129
D791,971 S * 7/2017 Myers ..... D25/68
2003/0015371 A1 * 1/2003 Coore ..... E06C 7/006 182/129
2009/0114479 A1 * 5/2009 Tate ..... E06C 7/006 182/230
2010/0018801 A1 * 1/2010 Allred ..... E06C 1/39 182/129
2012/0298448 A1 * 11/2012 Houdyshell ..... E06C 1/18 182/106

FOREIGN PATENT DOCUMENTS

GB 2370309 A * 6/2002 ..... E06C 7/006

OTHER PUBLICATIONS

OSHA Publication OSHA 3124-12R 20003, Stairways and Ladders: A Guide to OSHA Rules, p. 7; https://www.osha.gov/Publications/osha3124.pdf.

* cited by examiner

*Primary Examiner* — Alvin C Chin-Shue
(74) *Attorney, Agent, or Firm* — Gerald R. Prettyman

(57) ABSTRACT

Disclosed is a ladder safety device for use with step ladders. The ladder safety device has an upper portion for projecting over the top case of a step ladder, a middle bend, and a lower section provided with (1) a securing clip to secure the ladder safety device to the top case, (2) a solid section blocking use of the top step, and (3) an at least one additional securing and tamper-detection device to secure the ladder safety device to the ladder while discouraging tampering by providing evidence of tampering.

The ladder safety device has an upper section (105), an upper section handle (110), a section bend (115), a lower section (120), a top cap clip gap (125), an at least one top cap clip (130), an at least one lower section tamper seal securing tab (135), an at least one lower section securing bar structure (140), an at least one side rail overlapping tab (145), an at least one lower section rung clip (150), an at least one lower section rung tab (155), a ladder safety device securing bar (160) and an least one lower section tamper seal structure (165).

15 Claims, 8 Drawing Sheets

LADDER SAFETY DEVICE

CROSS-REFERENCE TO RELATED APPLICATION

This application claims the benefit of priority of U.S. Provisional Patent Application 62/863,794 filed Jun. 19, 2019 and titled "LADDER SAFETY DEVICE," the disclosure of which is incorporated by reference.

STATEMENT REGARDING FEDERALLY SPONSORED RESEARCH OR DEVELOPMENT

Not Applicable

BACKGROUND OF THE INVENTION

Field of Invention

The invention relates generally to the field of safety devices and more specifically to ladder safety devices for preventing falls from ladders due to unsafe use.

Description of Related Art

A ladder provides indispensible access to numerous projects for working above one's head. Regardless of whether painting a wall, trimming a tree, cleaning a gutter, or accessing an object or surface higher than arm's length, the first tool on the job is often a ladder.

With the recognition of a ladder as a needed tool, we then need to decide the type of ladder, which for most projects, may be the familiar 'A' style step ladder with its double pair of side rails, or the inclined style extension ladder.

For many projects, a step ladder should be used as the double pair of side rails provide four points of base contact and therefore the best stability.

In return for the best stability, a step ladder exacts a trade-off of not being extendable, and for following the unrelenting law of gravity: a step ladder's stability decreases as a person steps higher on a step ladder. If standing on the top rung, a person can safely lean just a fraction to one side as compared to standing on the rung below, while standing on the ladder top cap allows for no safe movement.

In spite of warning labels, training, and even with protection devices, hundreds of thousands of people fall annually in the U.S. from ladders, with hundreds of deaths.

SUMMARY OF THE INVENTION

Disclosed is a ladder safety device for use with step ladders, and which may be used with an extension or other ladder with modification.

The ladder safety device is capable of affixment to a ladder having a ladder top cap, a ladder top rung, a left front side rail and a right front side rail, and to compromise use of the ladder top rung by spanning between the ladder top cap and the ladder top rung and the left front side rail and the right front side rail. The ladder safety device aids in ladder fall prevention and will discourage/prevent unsafe misuse of at least the top rung by preventing access to at least the ladder top rung and the ladder top cap. The ladder safety device has an intrinsic ability to discourage removal and use circumvention with multiple layers of tamper misuse—removal notification.

The ladder safety device has an upper section projecting over a ladder top cap, a section bend, and a lower section, provided with (1) a securing clip to secure the ladder safety device to the ladder top cap via the front face (rung side), (2) a solid section compromising use of the top rung, (3) an at least one additional securing and tamper-detection device to secure the ladder safety device to the ladder while discouraging tampering by providing evidence of tampering, and (4) a securing clip to secure the ladder safety device to a rung.

The at least one securing and tamper resistant device could include one or more tamper resistant fasteners such as a crimp wire, cable tie, loop, which could be secured and then maybe hidden with a tamper resistant device, such as with a paint seal, hard sealant, or a holographic tamper sticker, and the ability to install a securing and tamper-detection device in a second location. Lower step clips could also be used. These methods can be part and parcel of a company's ladder safety program and monitored for adherence by a safety director for compliance.

Shown in the drawings are an upper section (105), an upper section handle (110), a section bend (115), a lower section (120), a top cap clip gap (125), an at least one top cap clip (130), an at least one lower section tamper seal securing tab (135), an at least one lower section securing bar structure (140), an at least one side rail overlapping tab (145), an at least one lower section rung clip (150), an at least one lower section rung tab (155), a ladder safety device securing bar (160), and an least one lower section tamper seal structure (165).

DETAILED DESCRIPTION OF THE INVENTION

Figure 1:
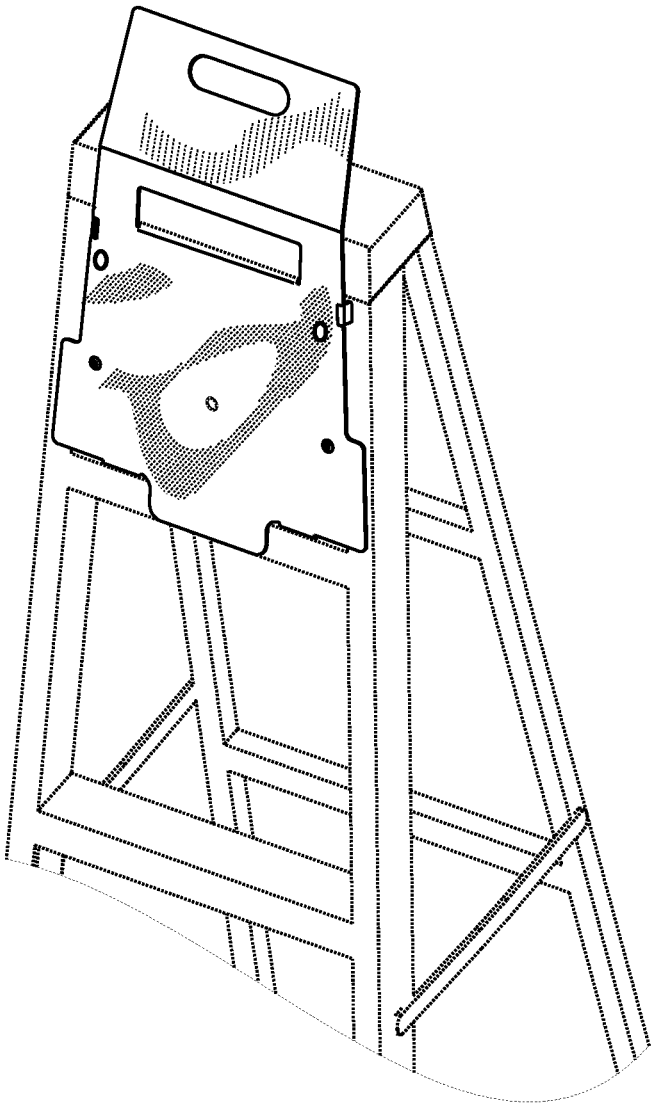
FIG. 1 shows a ladder safety device installed to prevent unsafe misuse of a step ladder.

FIG. 1 shows a top right perspective view of a ladder safety device installed to prevent unsafe misuse of a step ladder.

When properly affixed to a ladder, the ladder safety device blocks or compromises use of the top rung of a ladder, the ladder top cap, and blocks fingers and tools from prying the ladder safety device away from or off of the ladder.

As shown in FIG. 1, the ladder safety device is positioned and centered against the ladder front side rails such that the upper section projects over the ladder top cap, a securing clip (shown as one piece here) secures the ladder safety device to the ladder top cap (showing through the top cap clip gap), a solid section compromises use of the top rung, an at least one additional securing and tamper-detection device secures the ladder safety device to the ladder with a tamper resistant device, a securing clip secures the ladder safety device to a rung at the bottom of the ladder safety device (under the ring), and an at least one lower section rung tab projects over the rung at the bottom to aid stability of the ladder safety device and deter tampering with the ladder safety device.

Figure 2:
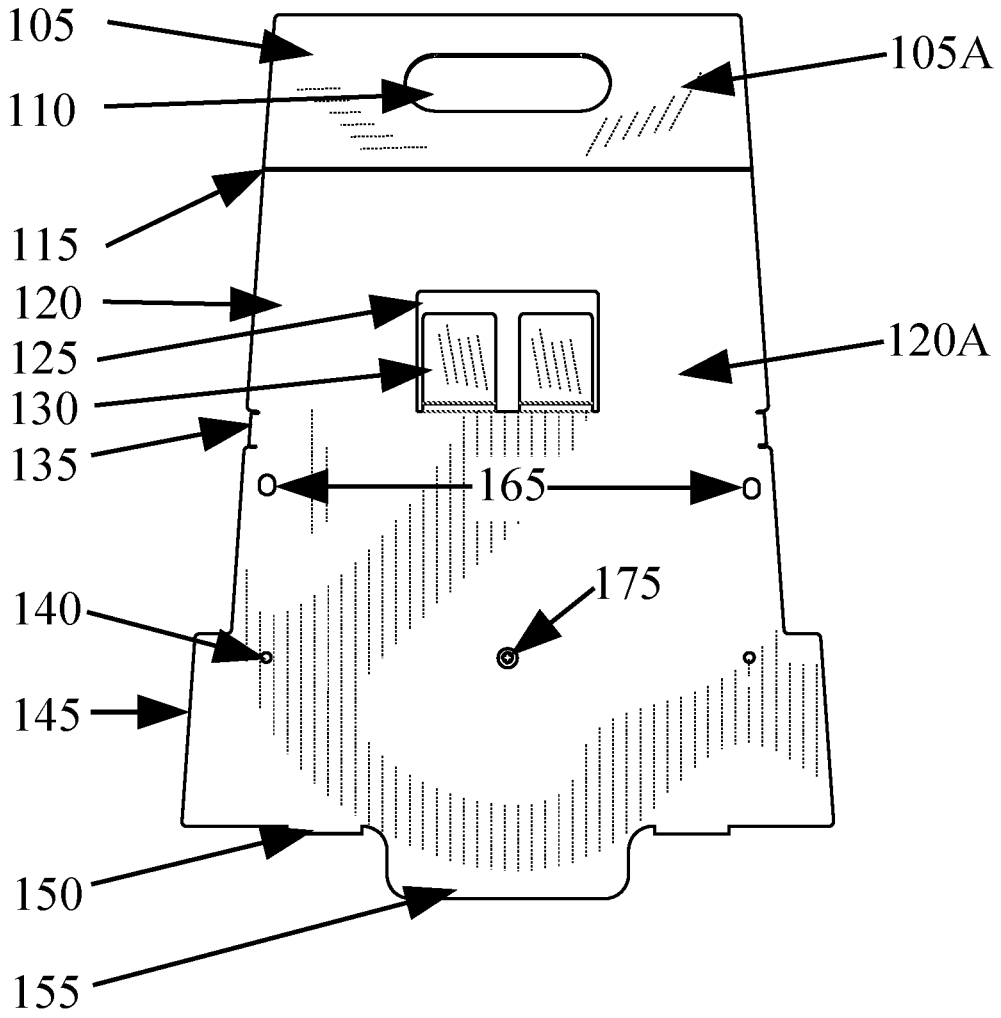
FIG. 2 shows, a front plan view of the ladder safety device.

FIG. 2 shows a front plan view of the ladder safety device.

Shown in FIG. 2 are the upper section (105), the upper section handle (110), the section bend (115), the lower section (120), the top cap clip gap (125), the at least one top cap clip (130), the at least one lower section securing bar structure (140), the at least one side rail overlapping tab (145), the at least one lower section rung clip (150), the at least one lower section rung tab (155) an least one lower section tamper seal structure (165), and a tamper resistant device (175).

With the ladder safety device affixed to a ladder as directed, the upper section (105) provides deterrence from standing on the ladder top cap. The upper section (105) may be made of any material. The upper section (105) may be made of a durable and tamper-resistant material. The upper section (105) could be a metal body, such as steel or aluminum, etc. The upper section (105) could be a plastic body, e.g., a hard plastic, such as a poly-vinyl compound, heavy polycarbonate, etc. The upper section (105) may be made of wood, or a composite of one of more of these materials. Manufacturing methods might be cutting, molding, extrusion, stamping, or other method. Some variations might consider a light-weight plastic that might be used for thermo-forming, such as styrene, ABS, PETG, or light-weight polycarbonate.

The upper section (105) may be a flat surface and have any width, any height, and any thickness. Multiple constructions may be used to block or complicate use of the ladder top cap as a step. The upper section (105) could project sufficiently to prevent a person from placing the toes or heels of both feet onto the ladder top cap. The upper section (105) compromises standing on the ladder top cap so that less than 16 square inches is accessible for standing, such as no more than a 4 inch by 4 inch square, or a 2 inch by 8 inch section. Another construction could be the upper section (105) projecting entirely over the ladder top cap.

To provide deterrence from standing on the ladder top cap, the upper section (105) should have the same width as the ladder top cap, and may project at an angle of 20 degrees with respect to the lower section (120). As the side rails of step ladders typically have an angle of about 75 from the horizontal, i.e., 15 degrees from the vertical, the upper section (105) projects at about 55 degrees over the ladder top cap.

The upper section (105) should have a commensurate height to project to project so far over the ladder top cap as to block a person's foot from placing even the toes on the ladder top cap. The upper section (105) could have a height of at least 6 inches.

The upper section (105) may angularly project at an angle of zero to 60 degrees relative to the lower section (120). The upper section (105) may angularly project at an angle of more than 60 degrees, even as much as 75 degrees, relative to the lower section (120) to decrease the angle of the upper section (105) projecting relative to the ladder top cap. Angles approaching the horizontal of the upper section (105) to the ladder top cap, however, can defeat the purpose of projecting the upper section (105) as to block a person's foot from placing toes on the ladder top cap.

The upper section (105) could have a curved shape. The upper section (105) could have a curved body extending, over across the ladder top cap. The upper section (105) could have a radius of 3 inches to 7 inches to cover the width of the ladder top cap.

The upper section (105) should have a thickness commensurate with the stiffness of the material to prevent bending of the upper section (105) that would compromise the upper section (105) from projecting over the ladder top cap to prevent a person from placing a foot onto the ladder top cap.

The upper section handle (110) provides a hand-hold for installation, as well as for during use of ladder safety device. The upper section handle (110) may have any structure.

The upper section handle (110) may be an internal structure of the upper section (105). While shown as an oval cut-out in the upper section (105), the upper section handle (110) may be a cut-out of any shape.

The upper section handle (110) may be an external structure coupled to the upper section (105). As an external structure, the upper section handle (110) may be made of any material. The upper section handle (110) may be a durable and tamper-resistant material. The durable and tamper-resistant material could be metal, such as steel or aluminum, etc.; a hard plastic, such as a poly-vinyl compound, heavy polycarbonate, etc.: wood, or a composite of one of more of these materials.

The upper section handle (110) may have any width and height. For ease of use, the upper section handle (110) should have a width and a height for clearance to permit a user's hand to fit within the upper section handle (110), or over the upper section handle (110) as appropriate.

Figure 3:
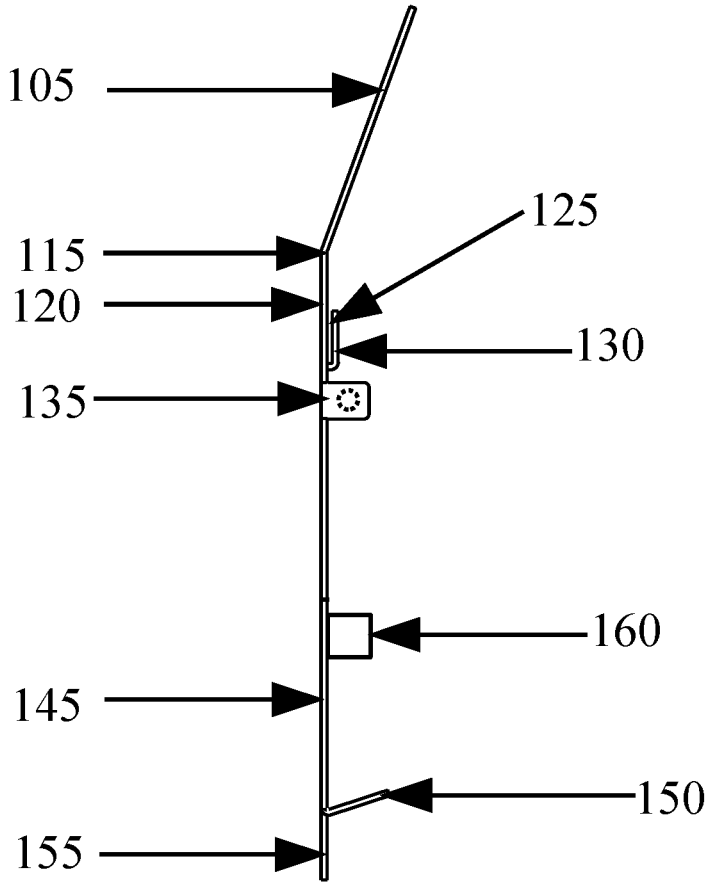
FIG. 3 shows a right side view of the ladder safety device.

The upper section (105) is coupled on an upper edge of a section bend (115), with the section bend (115) coupled to a lower edge of the upper section (105). The section bend (115) provides an angular structure to the ladder safety device so that the upper section (105) may have a different angle relative to the steps of the ladders from the angle of the lower section (120) and thus project the upper section (105) over the ladder top cap of the step ladder to block use of the ladder top cap as a step. FIG. 3 further discusses the section bend (115).

The section bend (115) has a lower edge to which is coupled a lower section (120).

The lower section (120) spans between the ladder top cap and the ladder top rung and the left front side rail and the right front side rail, and has affixed portions that cover over a portion of the left front side rail and a portion of the right front side rail and is capable of compromising use of the ladder top rung. The lower section (120) also operates as a unifying structure for other components of the ladder safety device.

The lower section (120) may be made of any material. The lower section (120) may be made of a durable and tamper-resistant material. The lower section (120) could be a metal body, such as steel or aluminum, etc. The lower section (120) could be plastic body, e.g., a hard plastic, such as a poly-vinyl compound, heavy polycarbonate, etc. The lower section (120) may be made of wood, or a composite of one of more of these materials.

The lower section (120) should have a thickness commensurate with the stiffness of the material to prevent bending or other distortion of the lower section (120) that would compromise the lower section (120) from blocking use of at least the top rung, of a ladder and blocking fingers and tools from prying the ladder safety device away from or off of the ladder.

Figure 4:
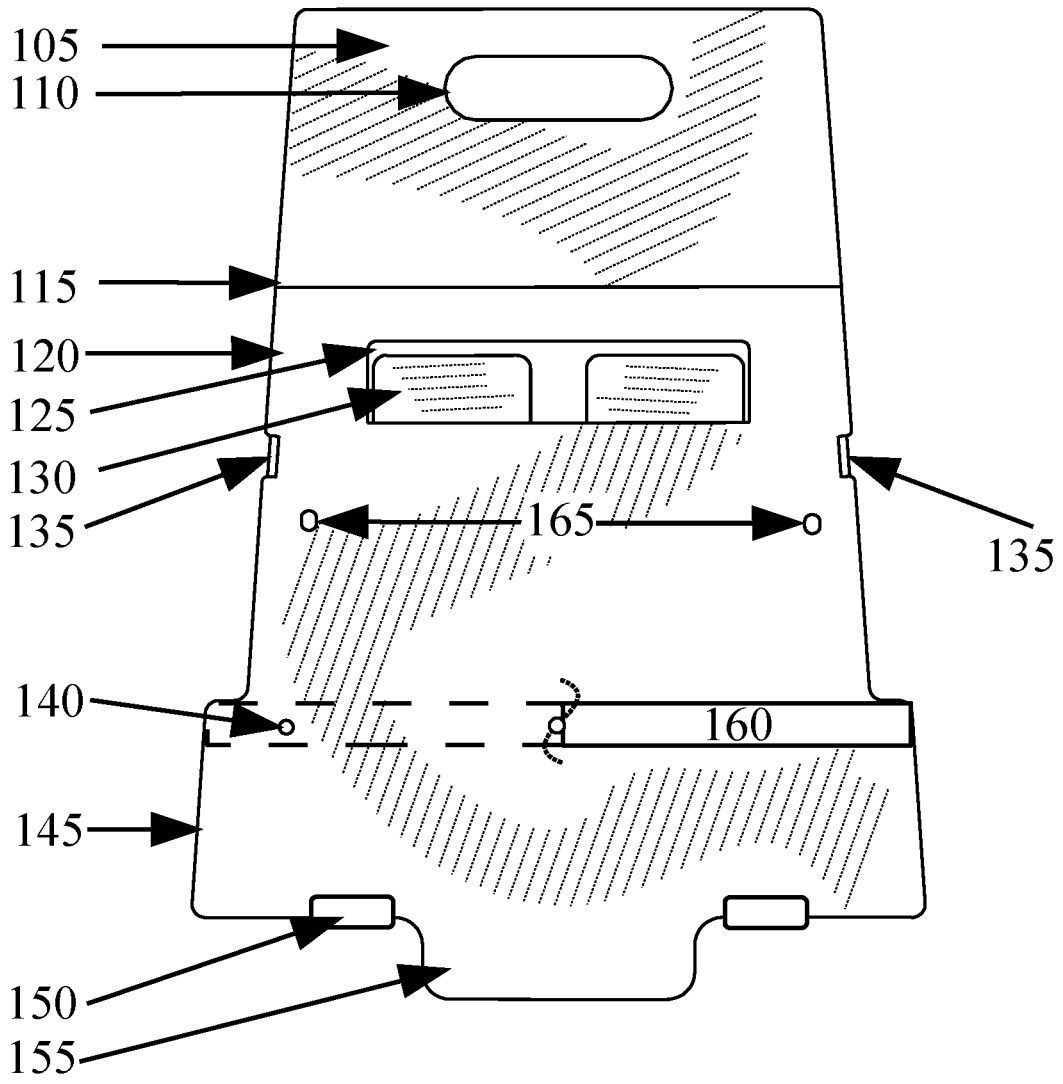
FIG. 4 shows a rear plan view of the ladder safety device.

FIG. 4 describes the top cap clip gap (125) and the at least one top cap clip (130).

The at least one lower section securing bar structure (140) is capable of securing the ladder safety device securing bar (160) to the back side of the lower section (120) and provides for an additional securing structure of the ladder safety device to a ladder. The at least one lower section securing bar structure (140) has at least one securing location within or on the lower section (120) for securing a ladder safety device securing bar (160) to the ladder safety device.

The at least one lower section securing bar structure (140) may be a securing structure for placement of a securing fastener through the lower section (120) for securing a ladder safety device securing bar (160) to the ladder. The securing fastener may be a bolt, screw, or other fastener. The securing fastener may include a tamper resistant device (175), such as an uncommon drive feature, e.g., torx, pins, key, etc., affixed to the at least one lower section securing bar structure (140) capable of affixing a ladder safety device securing bar (160) to a ladder.

The at least one lower section securing bar structure (140) may be a bolt, screw, or other fastener attached to the back of the lower section (120), as by being embedded in the back of the lower section (120), affixed to the back of the lower section (120) by welding, soldering, glue, etc.

The at least one lower section securing bar structure (140) may be anything capable of securing a ladder safety device securing bar (160) against the ladder front side rails.

The at least one lower section securing bar structure (140) may be made of any material. The at least one lower section securing bar structure (140) may be made of a durable and tamper-resistant material. The at least one lower section securing bar structure (140) could be a metal body, such as steel or aluminum, etc. The at least one lower section securing bar structure (140) could be plastic body, e.g., a hard, plastic, such as a poly-vinyl compound, heavy polycarbonate, etc. The at least one lower section securing bar structure (140) may be made of wood, or a composite of one of more of these materials.

The at least one lower section securing bar structure (140) should have a thickness commensurate with the stiffness of the material to prevent bending or other distortion of the at least one lower section securing bar structure (140) that would compromise the at least one lower section securing bar structure (140) securing, a ladder safety device securing bar (160) to the ladder safety device.

The at least one side rail overlapping tab (145) is capable of securing the ladder safety device securing bar (160) against a ladder front side rail to secure the ladder safety device securing bar (160) against the back side of the ladder side rail and thus secure the ladder safety device to the ladder.

The at least one side rail overlapping tab (145) may be present on the left side, the right side, both sides, or more than at least one side rail overlapping tab (145) may be present on the left side, the right side or both sides.

The at least one side rail overlapping tab (145) may be made of any material. The at least one side rail overlapping tab (145) may be made of a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials.

The at least one side rail overlapping tab (145) should have a thickness commensurate with the stiffness of the material to prevent bending or other distortion of the at least one side rail overlapping tab (145) that would compromise the at least one side rail overlapping tab (145) from securing the lower section (120) against one or more of the ladder front side rails against which the ladder safety device securing bar (160) is held on the back side of the ladder safety device.

FIG. 3 describes the at least one lower section rung clip (150).

When the ladder safety device is properly installed, the at least one lower section rung tab (155) is pressed against a front face of a rung against which the at least one side rail overlapping tab (145) has been positioned. FIG. 4 will further discuss the at least one lower section rung clip (150) and the at least one lower section rung tab (155).

FIG. 3 shows a right side view of the ladder safety device.

Shown in FIG. 3 are the upper section (105), the section bend (115), the lower section (120), the top cap clip gap (125), the at least one top cap clip (130), the at least one lower section tamper seal securing tab (135), the at least one side rail overlapping tab (145), the at least one lower section rung clip (150), and the at least one lower section rung tab (155).

The section bend (115) may have an angle of zero degrees to 60 degrees relative to the lower section (120), thus providing an angle of the upper section (105) 15 degrees to 75 degrees relative to the ladder top cap, and thus deter use of the ladder top cap as a step.

FIG. 4 describes the top cap clip gap (125) and the at least one top cap clip (130).

The at least one lower section tamper seal securing tab (135) projects from at least one side of the lower section (120) and fits between the lower section (120) and a side rail adjacent to the at least one lower section tamper seal securing tab (135).

The at least one lower section tamper seal securing tab (135) provides for securing a tamper resistant device from the at least one lower section tamper seal securing tab (135) to a ladder. Tampering with the tamper resistant device thereby indicates tampering activity with the safety integrity of the ladder safety device.

The at least one lower section tamper seal securing tab (135) may have a tether structure, which may be through-hole for securing a tamper resistant device from the at least one lower section tamper seal securing tab (135) to a ladder.

The at least one lower section tamper seal securing tab (135) may be present on the left side, the right side, both sides, or more than one lower section tamper seal securing tab (135) may be present on, the left side, the right side or both sides.

The at least one lower section tamper seal securing tab (135) may be used with many forms of tamper resistant devices, including but not limited to tamper resistant fasteners, tamper resistant labels, tamper evident stickers, holographic labels, tamper proof zip ties, tamper evident crimp wires, tamper evident key-rings, serialized tamper proof rings, such as wire rings, key rings, etc., hot melt tamper evidence, etc.

The at least one lower section tamper seal securing tab (135) may be made of any material. The at least one lower section tamper seal securing tab (135) may be made of a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials.

The at least one lower section tamper seal securing tab (135) should have a thickness commensurate with the stiffness of the material to prevent bending of the at least one lower section tamper seal securing tab (135) that would compromise the at least one lower section tamper seal securing tab (135) from securing a tamper resistant device from the at least one lower section tamper seal securing tab (135) to a ladder.

The at least one lower section rung clip (150) is capable of securing the ladder safety device against an underside of a ladder rung. The at least one lower section rung clip (150) should have a length commensurate with the width of rung to assure the at least one lower section rung clip (150) sufficiently engages against the rung.

The at least one lower section rung clip (150) may be made of any material. The at least one lower section rung clip (150) may be made of a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials.

The at least one lower section rung clip (150) should have a thickness commensurate with the stiffness of the material to prevent bending or other distortion of the at least one lower section rung clip (150) that would compromise the at least one lower section rung clip (150) from securing the ladder safety device against an underside of a rung of the ladder.

FIG. 4 shows a rear plan view of the ladder safety device.

Shown in FIG. 4 are the upper section (105), the upper section handle (110), the section bend (115), the lower section (120), the top cap clip gap (125), the at least one top cap clip (130), the at least one lower section tamper seal securing tab (135), the at least one lower section securing bar structure (140), the at least one side rail overlapping tab (145), the at least one lower section rung clip (150), the at least one lower section rung tab (155) and an at least one lower section tamper seal structure (165).

The top cap clip gap (125) offsets the at least one top cap clip (130) from the lower section (120) to provide spacing between the lower section (120) and the at least one top cap clip (130) for the front face of the ladder top cap to fit between the lower section (120) and the at least one top cap clip (130).

When used as directed, the lower section (120) is adjacent to an outer side face of the ladder top cap, with the at least one top cap clip (130) of the ladder safety device adjacent to an inner side face of the ladder top cap.

The top cap clip gap (125) should be deep enough and high enough (between the lower section (120) and the at least one top cap clip (130) for ladder top cap to fit easily and yet snugly between the lower section (120) and the at least one top cap clip (130).

Though the top cap clip gap (125) is shown as cut from the lower section (120), the lower section (120) can be solid in front of the top cap clip gap (125), such that the top cap clip gap (125) is not visible from the front of the lower section (120).

The at least one top cap clip (130) is affixed to the back side of the lower section to slip under and behind the front face (rung side) of a ladder top cap to secure the front face of the ladder top cap within the top cap clip gap (125) with the at least one top cap clip (130) adjacent to an inside face of the ladder top cap, so the lower section (120) is pulled tight against the ladder front side rails. This configuration provides one of several securing points of the ladder safety device to a ladder.

The at least one top cap clip (130) may be one piece across the top cap clip gap (125). For ladders having one or more ridges on the inside face of the ladder top cap. The at least one top cap clip (130) may be have two or more pieces across the top cap clip gap (125).

The at least one top cap clip (130) may be made of any material. The at least one top cap clip (130) may be made of a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials.

The at least one top cap clip (130) should have a thickness commensurate with the stiffness of the material to prevent bending of the at least one top cap clip (130) that would compromise the at least one top cap clip (130) from functioning as a securing point of the ladder safety device to a ladder.

The at least one lower section rung tab (155) projects from the bottom of the lower section (120) against a front face of a ladder rung and provides stability of the ladder safety device against slippage, and provides tamper resistance against tampering with the ladder safety device.

The at least one lower section rung tab (155) may be made of any material. The at least one lower section rung tab (155) may be a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials. Manufacturing methods might be cutting, molding, extrusion, stamping, or other method. Some variations might consider a light-weight plastic that might be used for thermo-forming, such as styrene, ABS, PETG, or light-weight polycarbonate.

The at least one lower section rung tab (155) should have a thickness commensurate with the stiffness of the material to prevent bending or other distortion of at least one lower section rung tab (155) that would compromise the at least one lower section rung tab (155) from providing stability of the ladder safety device against slippage, and provides tamper resistance against tampering with the ladder safety device.

Also shown in FIG. 4 is a section view of a ladder safety device securing bar (160). As shown in FIG. 4, the ladder safety device securing bar (160) projects across the width of the ladder safety device from an at least one lower section securing bar structure (140) near the left edge of the lower section (120), across the lower section (120), and then across an at least one lower section securing bar structure (140) near the edge of the lower section (120). As discussed above, a securing fastener may then secure the ladder safety device securing bar (160) via the at least one lower section securing bar structure (140) to the ladder front side rails and to the lower section (120) of the ladder safety device.

A securing fastener may terminate within the ladder safety device securing bar (160), or may pass through the ladder safety device securing bar (160).

The ladder safety device securing bar (160) may be made of any material. The ladder safety device securing bar (160) may be made of a durable and tamper-resistant material. The durable and tamper-resistant material could be metal, such as steel or aluminum, etc.; a hard plastic, such as a poly-vinyl compound, heavy polycarbonate, etc.; wood, or a composite of one of more of these materials. The ladder safety device securing bar (160) may be a rod, a bar, or other geometrically material. The ladder safety device securing bar (160) may be solid, or may be hollow.

The ladder safety device securing bar (160) should have a thickness commensurate with the stiffness of the material to prevent bending or other distortion of the ladder safety device securing bar (160) that would compromise the ladder safety device securing bar (160) from securing the lower section (120) against the rails of a ladder and the at least one side rail overlapping tab (145).

Figure 5:
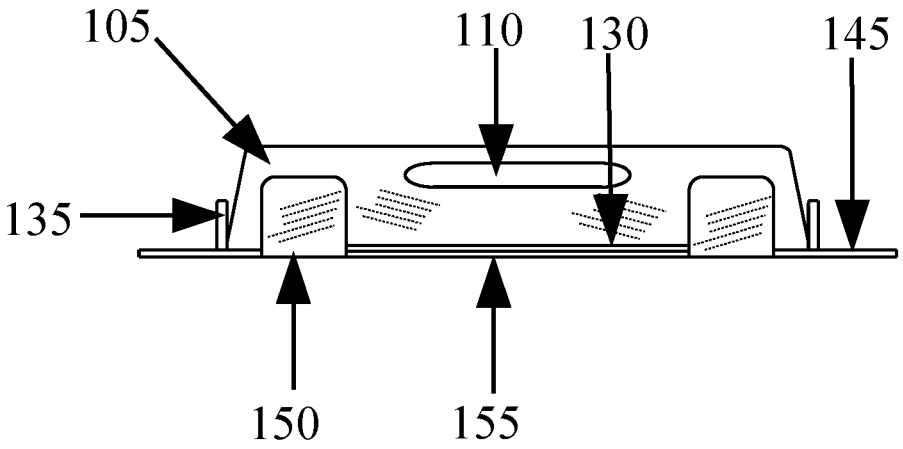
FIG. 5 shows a bottom plan view of the ladder safety device.

FIG. 5 shows a bottom plan view of the ladder safety device.

Shown in FIG. 5 are the upper section (105), the upper section handle (110), the top cap clip gap (125), the at least one top cap clip (130), the at least one lower section tamper seal securing tab (135), the at least one side rail overlapping tab (145), the at least one lower section rung clip (150), and the at least one lower section rung tab (155).

As shown in FIG. 5, the upper section (105) angular projects from the lower section (120). On either side of the upper section (105), the at, least one lower section tamper seal securing tab (135) project from the lower (120), with the at least one side rail overlapping tab (145) projecting to the respective sides of the ladder safety device. Below (in front as shown here), the at least one top cap clip (130) projects over the lower section (120), and can be seen between the at least one lower section rung clip (150).

Figure 6:
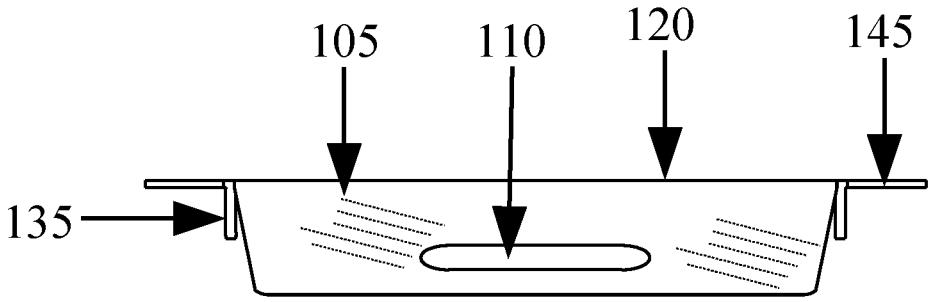
FIG. 6 shows a top plan view of the ladder safety device.

FIG. 6 shows a top plan view of the ladder safety device.

Shown in FIG. 6 are the upper section (105), the upper section handle (110), the at least one top cap clip (130), the at least one lower section tamper seal securing tab (135), the at least one side rail overlapping tab (145) and the least one lower section tamper seal structure (165).

As shown in FIG. 6, the upper section (105) angularly projects from the lower section (120). Also shown is the upper section handle (110), which provides a hand-hold for installation, as well as for during use of the ladder safety device.

On either side of the upper section (105), the at least one lower section tamper seal securing tab (135) projects, from the lower section (120), with the at least one side rail overlapping tab (145) projecting to the respective sides of the ladder safety device.

Figure 7:
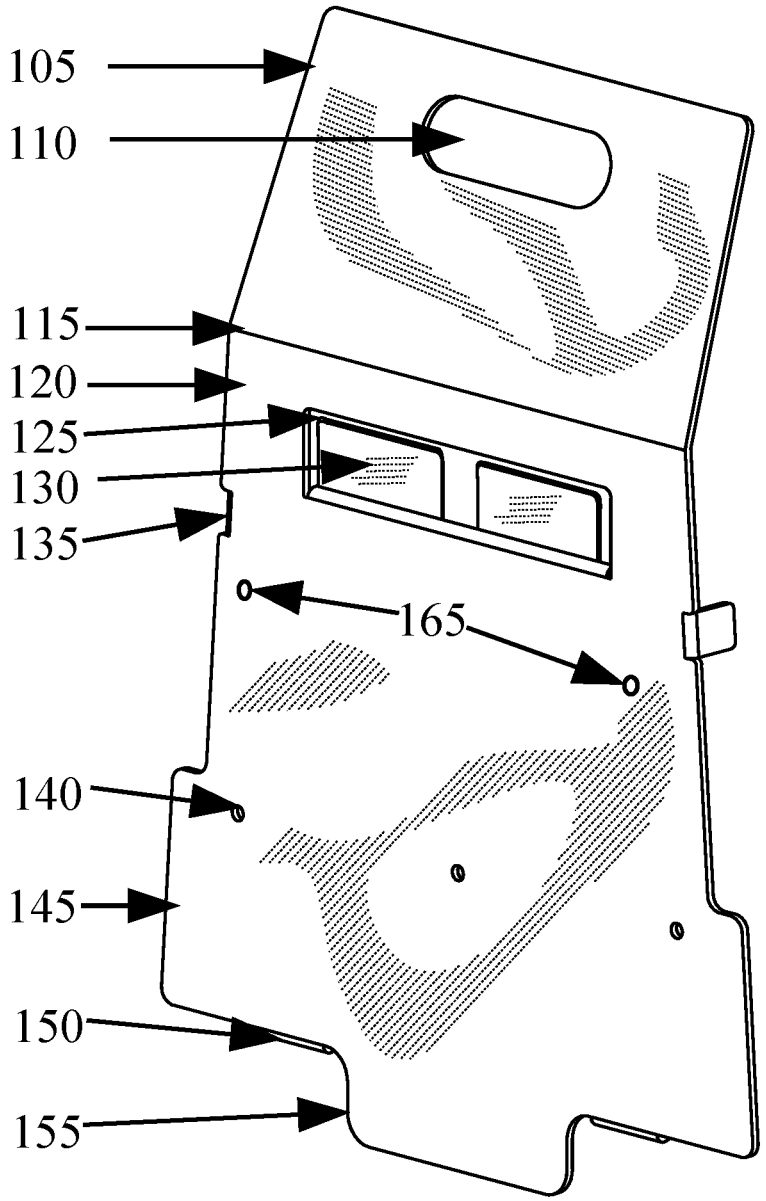
FIG. 7 shows a front right perspective plan view of the ladder safety device.

FIG. 7 shows a front right perspective plan view of the ladder safety device.

Shown in FIG. 7 are the upper section (105), the upper section handle (110), the section bend (115), the lower section (120), the top cap clip gap (125), the at least one top cap clip (130), the at least one lower section tamper seal securing tab (135), the at least one lower section securing bar structure (140), the at least one side rail overlapping tab (145), the at least one lower section rung clip (150), the at least one lower section rung tab (155) and an least one lower section tamper seal structure (165).

As shown in FIG. 7, the at least one lower section tamper seal securing tab (135) may or may not have a tether structure, which may be through-hole for securing a tamper seal from the at least one lower section tamper seal securing tab (135) to a ladder.

Figure 8:
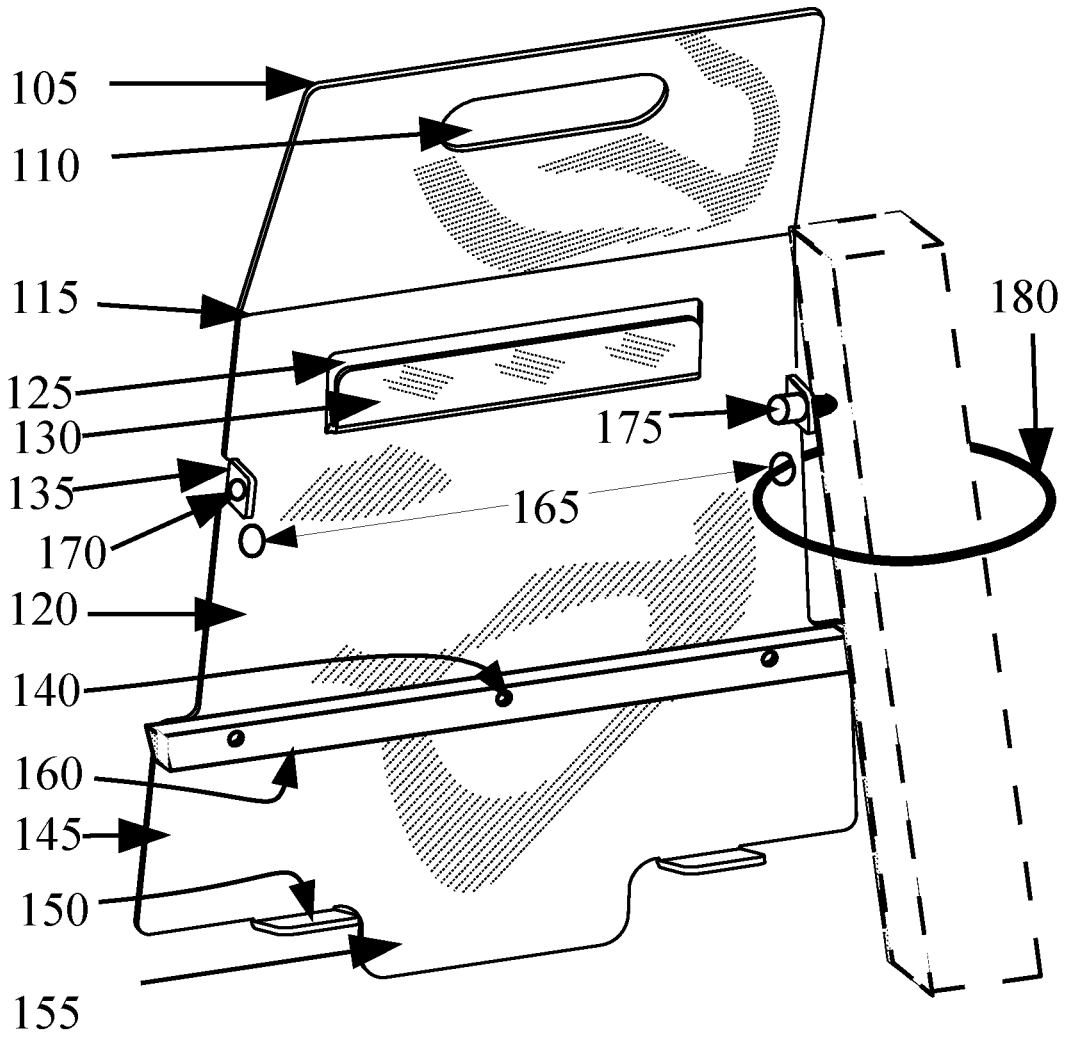
FIG. 8 shows a rear right perspective view of the ladder safety device.

FIG. 8 shows a rear right perspective view of the ladder safety device with a portion of left front side ladder rail adjacent to the ladder safety device.

Shown in FIG. 8 are the upper section (105), the upper section handle (110), the section bend (115), the lower section (120), the top cap clip gap (125), the at least one top cap clip (130) (shown as one piece here), the at least one lower section tamper seal securing tab (135), the at least one lower section securing bar structure (140), the at least one side rail overlapping tab (145), the at least one lower section rung clip (150), the at least one lower section rung tab (155) and an least one lower section tamper seal structure (165).

The at least one lower section tamper seal securing tab (135) may or may not have a tamper seal structure (170), which may be a through-hole for securing a tamper resistant device (175) through the at least one lower section tamper seal securing tab (135) and into a ladder side rail.

The lower section (120) may also have an least one lower section tamper seal structure (165) for affixing a tamper evident seal device, (180), or different or additional tamper evident seal devices thought the lower section and securing the ladder safety device to the ladder. As shown in FIG. 8, an least one lower section tamper seal structure (165) has a tamper evident seal device (180) in the form of a tamper evident crimp wire, which passes through the least one lower section tamper seal structure (165) and around a front side rail of the ladder. Other tamper evident seal devices may instead be used with least one lower section tamper seal structure (165) to secure a tamper evident seal device to other parts of the ladder, including cable ties, chains, bolts, etc.

These descriptions and drawings are embodiments and teachings of the disclosure. All variations are within the spirit and scope of the disclosure. This disclosure is not to be considered as limiting the claims to only the embodiments illustrated or discussed. Certain changes can be made in the subject matter without departing from the spirit and the scope of this invention. It is realized that changes are possible within the scope of this invention and it is further intended that each structure or element recited in any of the claims is to be understood as referring to all equivalent structure or elements. The following claims are intended to cover the invention as broadly as possible in whatever form it may be used.

I claim:

1. A ladder safety device capable of affixment to a ladder adjacent to a ladder top cap of a ladder having a ladder top cap, a ladder top rung, a left front side rail and a right front side rail comprising:

a lower section (120) having a front side and back side and preventing use of a ladder top rung by spanning between the ladder top cap, the ladder top rung and a left front side rail and aright front side rail, the lower section coupled via a section bend (115) to a flangeless single plane upper section (105) comprising a flat surface and a height of at least 6 inches and projecting angularly at an angle between 135 degrees and 175 degrees relative to the lower section (120) to project at least two inches above and over the ladder top cap to prevent standing on the ladder top cap and to prevent access to the ladder top cap, an at least one lower section securing bar structure (140) of securing a ladder safety device securing bar (160) to the back side of the lower section (120), and an at least one side rail overlapping tab (145) of securing the ladder safety device securing bar (160) against a ladder front side rail.

2. The ladder safety device of claim 1 further comprising an upper section handle (110).

3. The ladder safety device of claim 1 further comprising a top cap clip gap (125) within the lower section (120), and an at least one top cap clip (130) affixed to the back side of the lower section (120) and capable of securing a ladder top cap within the top cap clip gap (125) with the at least one top cap clip (130) adjacent to an inside face of the ladder top cap.

4. The ladder safety device of claim 1 further comprising an at least one lower section tamper seal securing tab (135) capable of securing a tamper resistant device (175) between the ladder safety device and a ladder.

5. The ladder safety device of claim 4 wherein the at least one lower section tamper seal securing tab (135) further comprises a tamper seal structure for securing a tamper resistant device (175) between the ladder safety device and a ladder.

6. The ladder safety device of claim 1 further comprising a tamper resistant device (175) affixed to the at least one lower section securing bar structure (140) capable of affixing the ladder safety device securing bar (160) to the ladder safety device.

7. The ladder safety device of claim 1 further comprising an at least one lower section rung clip (150) capable of securing the ladder safety device against an underside of a ladder rung.

8. The ladder safety device of claim 1 further comprising an at least one lower section rung tab (155) for stability of the ladder safety device against slippage and provides tamper resistance against tampering with the ladder safety device.

9. The ladder safety device of claim 1 wherein the upper section (105) comprises a metal body.

10. The ladder safety device of claim 1 wherein the upper section (105) comprises a plastic body.

11. The ladder safety device of claim 1 further comprising a section bend (115) coupled on a lower edge of the upper section (105), the section bend (115) capable of angularly projecting the upper section (105) over a ladder top cap.

12. The ladder safety device of claim 1 wherein the lower section (120) comprises a metal body.

13. The ladder safety device of claim 1 wherein the lower section (120) comprises a plastic body.

14. The ladder safety device of claim 1 further comprising a lower section tamper seal structure (165) capable of securing the ladder safety device to a ladder with a tamper evident seal device (180).

15. The ladder safety device of claim 14 wherein the tamper evident seal device (180) is a tamper evident crimp wire.

* * * * *